US007648427B2

(12) United States Patent
Isogawa

(10) Patent No.: US 7,648,427 B2
(45) Date of Patent: Jan. 19, 2010

(54) GOLF BALL

(75) Inventor: Kazuhiko Isogawa, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/149,675

(22) Filed: May 6, 2008

(65) Prior Publication Data

US 2008/0305891 A1 Dec. 11, 2008

(30) Foreign Application Priority Data

Jun. 7, 2007 (JP) ..... 2007-151258

(51) Int. Cl.
*A63B 37/06* (2006.01)

(52) U.S. Cl. ..... 473/373

(58) Field of Classification Search ..... 473/373, 473/374, 367, 368

See application file for complete search history.

(56) References Cited

U.S. PATENT DOCUMENTS

| | | | | |
|---|---|---|---|---|
| 5,743,816 | A * | 4/1998 | Ohsumi et al. | 473/376 |
| 5,772,531 | A * | 6/1998 | Ohsumi et al. | 473/376 |
| 5,780,169 | A * | 7/1998 | Hiraoka et al. | 428/517 |
| 5,967,907 | A * | 10/1999 | Takemura et al. | 473/373 |
| 6,071,201 | A | 6/2000 | Maruko et al. | |
| 6,271,296 | B1 * | 8/2001 | Nakamura et al. | 524/423 |
| 6,394,912 | B1 | 5/2002 | Nakamura et al. | |
| 6,605,009 | B1 | 8/2003 | Nakamura et al. | |
| 6,676,542 | B2 * | 1/2004 | Kato et al. | 473/377 |
| 2002/0037778 | A1 | 3/2002 | Nakamura et al. | |

FOREIGN PATENT DOCUMENTS

| | | | |
|---|---|---|---|
| JP | 11-417 | A | 1/1999 |
| JP | 11-57070 | A | 3/1999 |
| JP | 2000-229133 | A | 8/2000 |
| JP | 2001-17571 | A | 1/2001 |
| JP | 2002-502280 | A | 1/2002 |
| WO | WO-98/52652 | A1 | 11/1998 |

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has spherical core 4, and cover 6 provided so as to cover this core 4. The core 4 has spherical center 8, and mid layer 10 provided so as to cover this center 8. The center 8 is constituted with a styrene block-containing thermoplastic elastomer. The mid layer 10 is obtained by crosslinking a rubber composition. The cover 6 is constituted with a resin composition. The center 8 has a diameter of 18 mm or greater and 35 mm or less. The center 8 has a hardness H1 of equal to or less than 25. The center 8 has an amount of compressive deformation of 5.0 mm or greater and 10.0 mm or less, as measured with the initial load of 1 kgf and the final load of 10 kgf. The difference (H2−H1) between the surface hardness H2 of the core 4 and the hardness H1 of the center 8 is 25 or greater and 60 or less. The difference (H3−H1) between the hardness H3 of the cover 6 and the hardness H1 of the center 8 is 40 or greater and 65 or less.

5 Claims, 1 Drawing Sheet

GOLF BALL

This application claims priority on Patent Application No. 2007-151258 filed in JAPAN on Jun. 7, 2007. The entire contents of this Japanese Patent Application are hereby incorporated by reference.

BACKGROUND OF THE INVENTION

1. Field of the Invention

The present invention relates to golf balls. More particularly, the present invention relates to multi-piece golf balls having a center, a mid layer and a cover.

2. Description of the Related Art

Golf balls make a flight with accompanying back spin. Upon shots with an iron club, sufficient back spin leads to suppression of run of the golf ball after landing. The back spin is responsible for control performances upon shots with an iron club.

Top concern to golf players for golf balls is their flight performances. The golf players prefer golf balls which can achieve great flight distances upon shots with a driver. Excess spin impairs the flight performances upon shots with a driver. Golf balls which can be accompanied by suppressed spin upon shots with a driver have been demanded.

The golf players place great importance also on feel at impact of the golf balls. Thus, the golf players prefer soft feel at impact. Achievement of both favorable flight performances and feel at impact has been desired.

Japanese Unexamined Patent Application Publication No. Hei 11-417 discloses a golf ball including a core and a cover. This core has an inner layer and an outer layer. The inner layer is constituted with a thermoplastic elastomer. This inner layer has a great hardness. This inner layer impairs feel at impact. The inner layer having a great hardness is not responsible for suppression of the spin caused upon shots with a driver. This golf ball is inferior in flight performances.

Japanese Unexamined Patent Application Publication No. Hei 11-57070 (U.S. Pat. No. 6,071,201) discloses a golf ball having a core and a cover. This core has an inner layer and an outer layer. The inner layer is constituted with a resin, while the outer layer is constituted with a rubber composition. This inner layer has a great hardness. This inner layer impairs feel at impact. The inner layer having a great hardness is not responsible for suppression of the spin caused upon shots with a driver. This golf ball is inferior in flight performances.

Japanese Unexamined Patent Application Publication No. 2000-229133 (U.S. Pat. No. 6,605,009) discloses a golf ball having a core and a cover. This core has a central core (center) and an outer layer. The central core is constituted with a thermoplastic resin, while the outer layer is constituted with a rubber composition. This central core has a diameter of 3-15 mm. This central core is so small that it is not responsible for the feel at impact enough. This central core has a hardness greater than that of the outer layer. According to this golf ball, the spin is not suppressed enough.

Japanese Unexamined Patent Application Publication No. 2001-17571 (U.S. Pat. No. 6,394,912) discloses a golf ball having a core and a cover. This core has a center and an outer layer. The center is constituted with a thermoplastic resin. This center has a diameter of 3-18 mm. This center is so small that it is not responsible for the feel at impact and flight performance enough.

Golf players desire for further improvement of various performances of golf balls. An object of the present invention is to provide a golf ball that is excellent in the flight performances and feel at impact.

SUMMARY OF THE INVENTION

Golf ball according to one aspect of the present invention has a core, and a cover positioned outside this core. This core has a center, and a mid layer positioned outside this center. The base polymer of this center includes a thermoplastic elastomer as a principal component. This center has a diameter of 18 mm or greater and 35 mm or less. This center has a hardness H1 of equal to or less than 25. This center has an amount of compressive deformation of 5.0 mm or greater and 10.0 mm or less, as measured with the initial load of 1 kgf and the final load of 10 kgf. The difference (H2−H1) between the surface hardness H2 of the core and the hardness H1 of the center is 25 or greater and 60 or less.

In this golf ball, a soft and large center is responsible for the feel at impact. This center further suppresses the spin caused upon shots with a driver. Suppression of the spin leads to achievement of a great flight distance. This golf ball is excellent in the flight performance and feel at impact.

Preferably, the difference (H3−H1) between the hardness H3 of the cover and the hardness H1 of the center is 40 or greater and 65 or less.

Preferably, the base polymer of the center includes a styrene block-containing thermoplastic resin elastomer, a thermoplastic polyurethane elastomer, a thermoplastic polyester elastomer or a thermoplastic polyamide elastomer as a principal component.

Preferably, the mid layer is formed by crosslinking a rubber composition.

DESCRIPTION OF THE PREFERRED EMBODIMENTS

Figure 1:
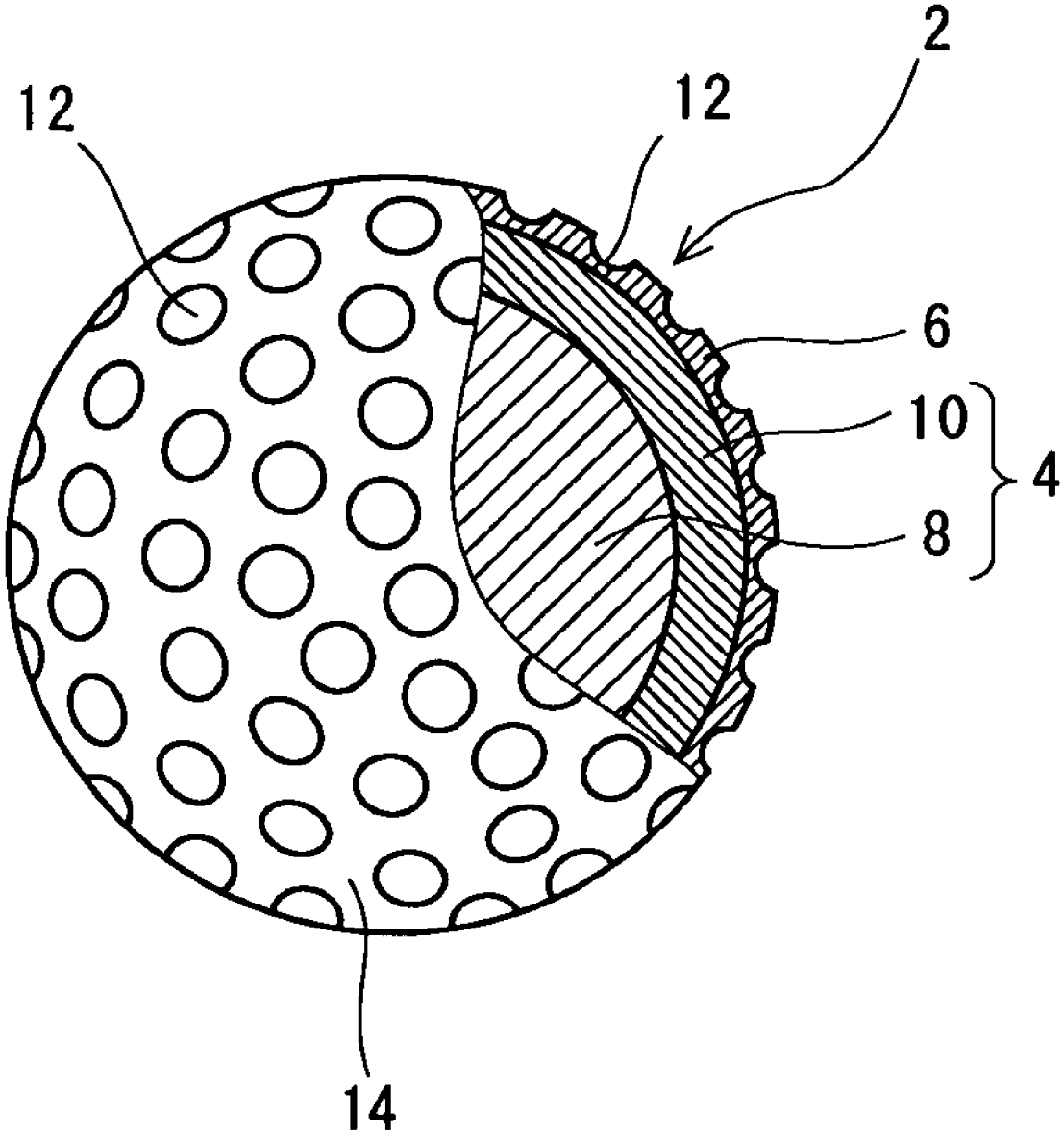
FIG. 1 shows a schematic cross-sectional view illustrating a golf ball according to one embodiment of the present invention.

The present invention will be hereinafter described in detail according to preferred embodiments with appropriate references to the accompanying drawing.

Golf ball shown in FIG. 1 has spherical core 4, and cover 6 provided so as to cover this core 4. The core 4 has spherical center 8, and mid layer 10 provided so as to cover this center 8. Numerous dimples 12 are formed on the surface of the cover 6. Of the surface of the golf ball 2, a part other than the dimples 12 is land 14. This golf ball 2 has a paint layer and a mark layer on the external side of the cover 6, although these layers are not shown in the FIGURE. Other layer may be formed between the center 8 and the mid layer 10. Other layer may be also provided between the mid layer 10 and the cover 6. The golf ball 2 may have a rib positioned on the surface of the core 4, or the surface of the center 8.

This golf ball 2 has a diameter of from 40 mm to 45 mm. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is preferably equal to or less than 45.93 g.

The center 8 has a hardness H1 of equal to or less than 25. This center 8 is soft. The soft center 8 serves in achieving soft feel at impact. Moreover, the soft center 8 suppresses the spin upon shots with a driver. Therefore, this golf ball 2 is excellent in the flight performance upon shots with a driver. In light of the feel at impact and flight performance, the hardness H1 is more preferably equal to or less than 20, and particularly preferably equal to or less than 18. The hardness H1 is preferably equal to or greater than 5.

In the present invention, the hardness H1 may be measured in accordance with a standard of "ASTM-D 2240-68" by using a Shore D type hardness scale attached to an automated rubber hardness measuring device (trade name "LA1", available from Koubunshi Keiki Co., Ltd.). For the measurement, a slab formed by hot pressing to have a thickness of about 2 mm is used. The slab stored at a temperature of 23° C. for two weeks is used for the measurement. When the measurement is carried out, three pieces of the slab are overlaid. For the measurement, a slab consisting of a composition for the center 8 is used.

The center 8 is constituted with an elastomer composition. The base polymer of this composition includes a thermoplastic elastomer as a principal component. The thermoplastic elastomer can provide a soft center 8. Illustrative examples of preferable thermoplastic elastomer include styrene block-containing thermoplastic elastomers, thermoplastic polyurethane elastomers, thermoplastic polyester elastomers and thermoplastic polyamide elastomers. Two or more kinds of the thermoplastic elastomers may be used in combination.

The styrene block-containing thermoplastic elastomer includes a polystyrene block as a hard segment, and a soft segment. Typical soft segment is a diene block. Illustrative examples of the compound for the diene block include butadiene, isoprene, 1,3-pentadiene and 2,3-dimethyl-1,3-butadiene. Butadiene and isoprene are preferred. Two or more compounds may be used in combination.

The styrene block-containing thermoplastic elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS or a hydrogenated product of SIBS. Exemplary hydrogenated product of SBS is a styrene-ethylene-butylene-styrene block copolymer (SEBS). Exemplary hydrogenated product of SIS is a styrene-ethylene-propylene-styrene block copolymer (SEPS). Exemplary hydrogenated product of SIBS is a styrene-ethylene-ethylene-propylene-styrene block copolymer (SEEPS).

In light of the resilience performance, the content of styrene component in this thermoplastic elastomer is preferably equal to or greater than 10% by weight, more preferably equal to or greater than 12% by weight, and particularly preferably equal to or greater than 15% by weight. In light of the soft feel at impact, the content is preferably equal to or less than 50% by weight, more preferably equal to or less than 47% by weight, and particularly preferably equal to or less than 45% by weight.

In the present invention, the styrene block-containing thermoplastic elastomer includes an alloy of olefin with one or more selected from the group consisting of SBS, SIS, SIBS, SEBS, SEPS and SEEPS, and hydrogenated products thereof. Preferably, olefin having 2 to 10 carbon atoms may be used. Illustrative examples of suitable olefin include ethylene, propylene, butene and pentene. Ethylene and propylene are particularly preferred.

Specific examples of the polymer alloy include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N", "Rabalon® MJ5302C", "Rabalon® MJ7301C" and "Rabalon® SR04", trade names, available from Mitsubishi Chemical Corporation. Specific examples of the styrene block-containing thermoplastic elastomer include "Epofriend® A1010", a trade name, available from Daicel Chemical Industries; and "Septon HG-252", a trade name, available from Kuraray Co., Ltd.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate.

Specific examples of the thermoplastic polyurethane elastomer include "Elastolan XNY80A", "Elastolan XNY85A", "Elastolan XNY90A", "Elastolan XNY97A", "Elastolan XNY585" and "Elastolan XKPO16N", trade names, available from BASF Japan Ltd; and "Rezamin P4585LS" and "Rezamin PS62490", trade names, available from Dainichiseika Color & Chemicals Mfg. Co., Ltd.

Specific examples of the thermoplastic polyester elastomer include "Hytrel® 4047", "Hytrel® 4767" and "Hytrel® 5557", trade names, available from Du Pont-TORAY Co., LTD., and "Primalloy® A1500", a trade name, available from Mitsubishi Chemical Corporation. Specific examples of the thermoplastic polyamide elastomer include "Pebax 2533", a trade name, available from Toray Industries, Inc.

The styrene block-containing thermoplastic elastomer is particularly suited for use in the center 8. This elastomer is responsible for soft feel at impact. This elastomer is responsible also for resilience performance of the golf ball 2. Furthermore, the center 8 can be readily formed through the use of this elastomer. When the styrene block-containing thermoplastic elastomer is used in combination with other elastomer, the styrene block-containing thermoplastic elastomer is preferably included as a principal component. The proportion of the styrene block-containing thermoplastic elastomer in the base polymer is preferably equal to or greater than 50% by weight, and more preferably equal to or greater than 70% by weight.

The center 8 has a diameter of equal to or greater than 18 mm. This center 8 has a large diameter. The soft center 8 having a large diameter leads to achievement of soft feel at impact, and to suppression of the spin. In this respect, the diameter is more preferably equal to or greater than 19 mm, and particularly preferably equal to or greater than 20 mm. Too large center 8 may deteriorate durability of the golf ball 2. In this respect, the diameter is preferably equal to or less than 35 mm, more preferably equal to or less than 33 mm, and particularly preferably equal to or less than 31 mm.

The amount of compressive deformation of the center 8 is preferably equal to or greater than 5.0 mm. This center 8 sufficiently suppresses the spin. In this respect, the amount of compressive deformation is more preferably equal to or greater than 5.5 mm. In light of durability of the golf ball 2, the amount of compressive deformation is preferably equal to or less than 10.0 mm, and more preferably equal to or less than 7.0 mm.

Upon measurement of the amount of compressive deformation, the center 8 is placed on a metal hard plate. A metal cylinder gradually descends toward the center 8. The center 8 intervened between the bottom face of the cylinder and the hard plate is deformed. A migration distance of the cylinder, starting from the state in which initial load of 1 kgf is applied to the center 8 up to the state in which final load of 10 kgf is applied thereto is measured.

The center 8 is obtained by injection molding. Molten elastomer composition is injected toward a spherical cavity of a mold. The composition is hardened in the cavity, whereby the center 8 is obtained. The center 8 may be also obtained by compression molding.

The elastomer composition of the center 8 may include additives such as a filler, a colorant, a dispersant, and the like.

The center 8 has a specific gravity of preferably 0.80 or greater and 1.00 or less. When the specific gravity of the center 8 is too low, the mid layer 10 must include a large amount of filler for achieving an appropriate mass of the golf ball 2. Such a mid layer 10 may deteriorate the resilience performance of the golf ball 2. The center 8 having such a great specific gravity shall include a large amount of filler. Such a center 8 may deteriorate the resilience performance of the golf ball 2. The specific gravity of the center 8 set to fall within the range of 0.80 or greater and 1.00 or less can lead to contribution of the center 8 and the mid layer 10 to the resilience performance of the golf ball 2. The specific gravity is more preferably equal to or greater than 0.85. The specific gravity is more preferably equal to or less than 0.95.

The mid layer 10 is constituted with a thermoplastic material or a thermosetting material. In light of the resilience performance, the mid layer 10 obtained by crosslinking a rubber composition is preferred. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene be included as a principal component. Specifically, it is preferred that the proportion of polybutadiene in the entire base rubber is equal to or greater than 50% by weight, and particularly equal to or greater than 80% by weight. Polybutadienes having a percentage of cis-1,4 bonds of equal to or greater than 40%, and particularly equal to or greater than 80% are preferred.

For crosslinking of the mid layer 10, a co-crosslinking agent is preferably used. Preferable examples of the co-crosslinking agent in light of the resilience performance include monovalent or bivalent metal salts of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

In light of the resilience performance of the golf ball 2, the amount of the co-crosslinking agent is preferably equal to or greater than 10 parts by weight, and more preferably equal to or greater than 15 parts by weight per 100 parts by weight of the base rubber. In light of soft feel at impact, the amount of the co-crosslinking agent is preferably equal to or less than 50 parts by weight, and more preferably equal to or less than 45 parts by weight per 100 parts by weight the base rubber.

Preferably, the rubber composition for use in the mid layer 10 includes organic peroxide together with the co-crosslinking agent. The organic peroxide serves as a crosslinking initiator. The organic peroxide is responsible for the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the organic peroxide is preferably equal to or greater than 0.1 parts by weight, more preferably equal to or greater than 0.3 parts by weight, and particularly preferably equal to or greater than 0.5 parts by weight per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight per 100 parts by weight of the base rubber.

Preferably, the rubber composition for use in the mid layer 10 includes an organic sulfur compound. Illustrative examples of preferable organic sulfur compound include mono-substituted forms such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; di-substituted forms such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; tri-substituted forms such as bis(2,4,6-trichlorophenyl)disulfide and bis(2-cyano-4-chloro-6-bromophenyl)disulfide; tetra-substituted forms such as bis(2,3,5,6-tetrachlorophenyl)disulfide; and penta-substituted forms such as bis(2,3,4,5,6-pentachlorophenyl)disulfide and bis(2,3,4,5,6-pentabromophenyl)disulfide. The organic sulfur compound is responsible for the resilience performance. Particularly preferred organic sulfur compounds are diphenyl disulfide and bis(pentabromophenyl)disulfide.

In light of the resilience performance of the golf ball 2, the amount of the organic sulfur compound is preferably equal to or greater than 0.1 parts by weight, and more preferably equal to or greater than 0.2 parts by weight per 100 parts by weight of the base rubber. In light of soft feel at impact, the amount of the organic sulfur compound is preferably equal to or less than 1.5 parts by weight, more preferably equal to or less than 1.0 parts by weight, and particularly preferably equal to or less than 0.8 parts by weight per 100 parts by weight of the base rubber.

Into the mid layer 10 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler is determined ad libitum so that the intended specific gravity of the mid layer 10 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount to the mid layer 10 as needed. Into the mid layer 10 may be also blended crosslinked rubber powder or synthetic resin powder.

The mid layer 10 has a specific gravity of preferably 1.05 or greater and 1.40 or less. When the specific gravity of the mid layer 10 is too low, the center 8 must include a large amount of filler for achieving an appropriate mass of the golf ball 2. Such a center 8 may deteriorate the resilience performance of the golf ball 2. The mid layer 10 having such a great specific gravity shall include a large amount of filler. Such a mid layer 10 may deteriorate the resilience performance of the golf ball 2. The specific gravity of the mid layer 10 set to fall within the range of 1.05 or greater and 1.40 or less can lead to contribution of the center 8 and the mid layer 10 to the resilience performance of the golf ball 2. The specific gravity is more preferably equal to or greater than 1.10. The specific gravity is more preferably equal to or less than 1.30.

The mid layer 10 has a thickness of preferably 4.0 mm or greater and 14.0 mm or less. The mid layer 10 having a thickness of equal to or greater than 4.0 mm can be responsible for the resilience performance of the golf ball 2. Furthermore, the mid layer 10 having a thickness of equal to or greater than 4.0 mm is excellent in durability. In these respect, the thickness is more preferably equal to or greater than 6.0 mm. Owing to the mid layer 10 having a thickness of equal to or less than 14.0 mm, a great launch angle of the golf ball 2 can be achieved. In this respect, the thickness is more preferably equal to or less than 12.0 mm.

The core 4 has a surface hardness H2 of preferably 46 or greater and 62 or less. By the core 4 having a surface hardness H2 of equal to or greater than 46, the spin can be suppressed. In this respect, the surface hardness H2 is more preferably equal to or greater than 50. By the core 4 having a surface hardness H2 of equal to or less than 62, soft feel at impact can be achieved. In this respect, the surface hardness H2 is more preferably equal to or less than 59. The surface hardness H2 may be measured by pressing a Shore D type hardness scale attached to an automated rubber hardness measuring device (trade name "LA1", available from Koubunshi Keiki Co., Ltd.) against the surface of the core 4.

The difference (H2−H1) between the surface hardness H2 of the core 4 and the hardness H1 of the center 8 is preferably 25 or greater and 60 or less. The core 4 which results in the difference (H2−H1) of equal to or greater than 25 can suppress the spin. In this respect, the difference (H2−H1) is more preferably equal to or greater than 35, and particularly preferably equal to or greater than 42. The core 4 which results in the difference (H2−H1) of equal to or less than 60 provides favorable durability. In this respect, the difference (H2−H1) is more preferably equal to or less than 51, and particularly preferably equal to or less than 49.

The amount of compressive deformation of the core 4 is preferably 2.7 mm or greater and 4.0 mm or less. By the core 4 having the amount of compressive deformation of equal to or greater than 2.7 mm, soft feel at impact can be achieved. In this respect, the amount of compressive deformation is more preferably equal to or greater than 3.0 mm. The core 4 having the amount of compressive deformation of equal to or less than 4.0 mm is responsible for the resilience performance of the golf ball 2. In this respect, the amount of compressive deformation is more preferably equal to or less than 3.7 mm, and particularly preferably equal to or less than 4.8 mm.

Upon measurement of the amount of compressive deformation, the core 4 is placed on a metal hard plate. A metal cylinder gradually descends toward the core 4. The core 4 intervened between the bottom face of the cylinder and the hard plate is deformed. A migration distance of the cylinder, starting from the state in which initial load of 98 N is applied to the core 4 up to the state in which final load of 1274 N is applied thereto is measured.

The core 4 is obtained by compression molding. The center 8 is covered by two half shells constituted with an uncrosslinked rubber composition, and the half shells with the center 8 are placed in a mold. The mold is closed, and then the rubber composition is compressed while heating. The compression and heating allows the rubber composition to flow. The heating causes a crosslinking reaction of the rubber. Crosslinking temperature is 140° C. or greater and 180° C. or less. The crosslinking time period is 10 minutes or longer and 60 minutes or less. The mid layer 10 may be also obtained by injection molding.

The cover 6 is constituted with a resin composition. Preferable base resin of the resin composition is an ionomer resin. The cover 6 including an ionomer resin can achieve excellent resilience performance of the golf ball 2.

Examples of preferred ionomer resin include binary copolymers formed with α-olefin and an α,β-unsaturated carboxylic acid having 3 to 8 carbon atoms. Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Examples of preferable other ionomer resin include ternary copolymers formed with α-olefin, an α,β-unsaturated carboxylic acid having 3 to 8 carbon atoms and an α,β-unsaturated carboxylate ester having 2 to 22 carbon atoms. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. Among these binary copolymers and ternary copolymers, preferable α-olefin may be ethylene and propylene, while preferable α,β-unsaturated carboxylic acid may be acrylic acid and methacrylic acid. Particularly preferred ionomer resin is a copolymer formed with ethylene, and acrylic acid or methacrylic acid.

In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318" and "Himilan MK7320", trade names, available from Du Pont-MITSUI POLYCHEMICALS Co., Ltd.; "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945" and "Surlyn® AD8546", trade names, available from Dupont; and "IOTEK 7010", "IOTEK 7030", "IOTEK 7510", "IOTEK 7520", "IOTEK 8000" and "IOTEK 8030", trade names, available from EXXON Mobil Chemical Corporation. Two or more kinds of the ionomer resin may be used in combination. An ionomer resin neutralized with a monovalent metal ion, and an ionomer resin neutralized with a bivalent metal ion may be used in combination.

In the cover 6, a styrene block-containing thermoplastic elastomer, a thermoplastic polyurethane elastomer, a thermoplastic polyester elastomer, a thermoplastic polyamide elastomer or a thermoplastic polyolefin elastomer may be used. The ionomer resin and other resin may be used in combination. When they are used in combination, the ionomer resin is preferably included as a principal component in light of the resilience performance. The proportion of the ionomer resin in the total amount of the base resin is preferably equal to or greater than 70% by weight, and more preferably equal to or greater than 80%.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Also, the cover 6 can be blended with powder of a highly dense metal such as tungsten, molybdenum or the like for the purpose of adjusting the specific gravity.

The cover 6 has a thickness of preferably 0.3 mm or greater and 1.9 mm or less. The cover 6 having a thickness of equal to or greater than 0.3 mm can be readily formed. In this respect, the thickness is more preferably equal to or greater than 0.4 mm, and particularly preferably equal to or greater than 0.5 mm. Owing to the cover 6 having a thickness of equal to or less than 1.9 mm, a great launch angle of the golf ball 2 can be achieved. In this respect, the thickness is more preferably equal to or greater than 1.7 mm, and particularly preferably equal to or greater than 1.5 mm.

The cover 6 has a hardness H3 of preferably 55 or greater and 66 or less. By the cover having a hardness H3 of equal to or greater than 55, the spin can be suppressed. In this respect, the hardness H3 is more preferably equal to or greater than 57, and particularly preferably equal to or greater than 58. The cover 6 having a hardness H3 of equal to or less than 66 is apt to more readily follow deformation of the core 4. This cover 6 is excellent in durability. In this respect, the hardness H3 is more preferably equal to or less than 65, and particularly preferably equal to or less than 63. The hardness H3 of the cover 6 is measured in a similar manner to the measurement of the hardness H1 of the center 8. For the measurement, a slab consisting of a resin composition of the cover 6 is used.

The cover 6 is obtained by injection molding. The cover 6 may be also formed by compression molding.

The difference (H3−H1) between the hardness H3 of the cover 6 and the hardness H1 of the center 8 is preferably 40 or greater and 65 or less. According to the golf ball 2 having the difference (H3−H1) of equal to or greater than 40, the spin can be suppressed. In this respect, the difference (H3−H1) is more preferably equal to or greater than 45, and particularly preferably equal to or greater than 50. According to the golf ball 2 having the difference (H3−H1) of equal to or less than 65, the cover 6 is apt to more readily follow deformation of the core 4. This golf ball 2 is excellent in durability. In this respect, the difference (H3−H1) is more preferably equal to or less than 62, and particularly preferably equal to or less than 60.

It is preferred that the golf ball 2 has the amount of compressive deformation of 2.5 mm or greater and 3.8 mm or less. The golf ball 2 having the amount of compressive deformation of equal to or greater than 2.5 mm is excellent in feel at impact. In this respect, the amount of compressive deformation is more preferably equal to or greater than 2.7 mm, and particularly preferably equal to or greater than 2.9 mm. The golf ball 2 having the amount of compressive deformation of equal to or less than 3.8 mm is excellent in the resilience performance. In this respect, the amount of compressive deformation is more preferably equal to or less than 3.5 mm, and particularly preferably equal to or less than 3.4 mm.

Upon measurement of the amount of compressive deformation, the golf ball 2 is placed on a metal hard plate. A metal cylinder gradually descends toward the golf ball 2. The golf ball 2 intervened between the bottom face of the cylinder and the hard plate is deformed. A migration distance of the cylinder, starting from the state in which initial load of 98 N is applied to the golf ball 2 up to the state in which final load of 1274 N is applied thereto is measured.

EXAMPLES

Example 1

A spherical center was formed from 100 parts by weight of a styrene block-containing thermoplastic elastomer (the aforementioned "Rabalon® SR04") by injection molding. This center had a diameter of 22.0 mm. A rubber composition was obtained by kneading 100 parts by weight of high-cis polybutadiene (trade name "BR-51" available from JSR Corporation), 36 parts by weight of zinc diacrylate, 5 parts by weight of zinc oxide, an adequate amount of barium sulfate, 0.5 parts by weight of diphenyl disulfide (Sumitomo Seika Chemicals Co., Ltd.) and 0.8 parts by weight of dicumyl peroxide (NOF Corporation). Half shells were formed with this rubber composition. The center was covered by two half shells. The center and the half shells were placed into a mold, and heated at 170° C. for 20 min to obtain a core having a diameter of 40.0 mm. A resin composition was obtained by kneading 52 parts by weight of an ionomer resin (the aforementioned "Surlyn® 8945"), 40 parts by weight of other ionomer resin (the aforementioned "Surlyn® 9945"), 8 parts by weight of a styrene block-containing thermoplastic elastomer (the aforementioned "Rabalon T3221C"), 3 parts by weight of titanium dioxide and 0.1 parts by weight of Ultramarine blue in a biaxial kneading extruder. This resin composition was rendered to cover around the core by injection molding to form a cover. A clear paint containing a two-component cured polyurethane as a base was applied onto this cover to give a golf ball of Example 1 having a diameter of 42.8 mm, and a weight of about 45.4 g.

Examples 2 to 7 and Comparative Examples 1 to 6

Golf balls of Examples 2 to 7 and Comparative Examples 1 to 6 were obtained in a similar manner to Example 1 except that specifications of the center, the mid layer and the cover were as listed in Tables 4 and 5 below. Specifications of the composition of the center are listed in the following Table 1; specifications of the composition of the mid layer are listed in the following Table 2; and specifications of the composition of the cover are listed in the following Table 3.

TABLE 1

| Composition of center | | | (parts by weight) |
|---|---|---|---|
| | a | b | c |
| Rabalon ® SR04 | 100 | — | — |
| Rabalon ® MJ5302C | — | 100 | — |
| Rabalon ® MJ7301C | — | — | 100 |
| Hardness (Shore D) | 10 | 18 | 29 |

TABLE 2

| Composition of mid layer (parts by weight) | d | e | f | g | h | i | j |
|---|---|---|---|---|---|---|---|
| BR-51 | 100 | 100 | 100 | 100 | 100 | 100 | 100 |
| Zinc diacrylate | 36 | 34 | 32 | 38 | 40 | 26 | 52 |
| Zinc oxide | 5 | 5 | 5 | 5 | 5 | 5 | 5 |
| Barium sulfate* | adequate amount | adequate amount | adequate amount | adequate amount | adequate amount | adequate amount | adequate amount |
| Diphenyl disulfide | 0.5 | 0.5 | 0.5 | 0.5 | 0.5 | 0.5 | 0.5 |
| Dicumyl peroxide | 0.8 | 0.8 | 0.8 | 0.8 | 0.8 | 0.8 | 0.8 |

*Adjust to give the mass of the ball becomes 45.4 g

TABLE 3

| Composition of cover | k | l | (parts by weight) m |
|---|---|---|---|
| Surlyn ® 8945 | 52 | 44 | 60 |
| Surlyn ® 9945 | 40 | 40 | 40 |
| Rabalon T3221C | 8 | 16 | — |
| Titanium dioxide | 3 | 3 | 3 |
| Ultramarine blue | 0.1 | 0.1 | 0.1 |
| Hardness (Shore D) | 59 | 54 | 65 |

Evaluation of Durability

A driver equipped with a titanium head (trade name "XXIO", available from SRI Sports Limited, shaft hardness: S, loft angle: 10°) was attached to a swing machine available from True Temper Co. The golf balls were hit with this swing machine under the condition to provide a head speed of 45 m/sec. Accordingly, impact of the golf ball on a metal plate was made. Number of times of hitting required until a breakage occurs on the golf ball was determined. Mean values of data obtained by the determination of five times are presented in Tables 4 and 5 below as indices.

Flight Distance Test

The golf balls were hit with the swing machine described above under the condition to provide a head speed of 45 m/sec. Accordingly, the distance from the launching point to the point where the ball stopped was measured. Mean values of data obtained by the measurement of 10 times are presented in Tables 4 and 5 below.

Evaluation of Feel at Impact

The golf balls were hit by a golf player, and the feel at impact was rated as follows:

A: extremely favorable

B: favorable

C: somewhat unfavorable

D: unfavorable

The results are presented in Tables 4 and 5 below.

TABLE 4

| Evaluation Results | | Example 1 | Compara. Example 1 | Example 2 | Compara. Example 2 | Compara. Example 3 | Compara. Example 4 | Compara. Example 5 |
|---|---|---|---|---|---|---|---|---|
| Center | composition | a | a | a | a | c | a | c |
| | hardness H1 (Shore D) | 10 | 10 | 10 | 10 | 29 | 10 | 29 |
| | diameter (mm) | 22.0 | 16.0 | 30.0 | 36.0 | 22.0 | 22.0 | 22.0 |
| | specific gravity (g/cm$^3$) | 0.89 | 0.89 | 0.89 | 0.89 | 0.89 | 0.89 | 0.89 |
| | amount of compressive deformation (1kgf→10kgf) (mm) | 5.5 | 5.5 | 5.5 | 5.5 | 3.8 | 5.5 | 3.8 |
| Mid layer | composition | d | e | d | h | i | j | d |
| | thickness (mm) | 9.0 | 12.0 | 5.0 | 2.0 | 9.0 | 9.0 | 9.0 |
| | specific gravity (g/cm$^3$) | 1.19 | 1.16 | 1.19 | 1.80 | 1.19 | 1.19 | 1.19 |
| Core | surface hardness H2 (Shore D) | 59 | 57 | 59 | 63 | 52 | 71 | 59 |
| | diameter (mm) | 40.0 | 40.0 | 40.0 | 40.0 | 40.0 | 40.0 | 40.0 |
| | amount of compressive deformation (98N→1274N) (mm) | 3.5 | 3.5 | 3.9 | 3.5 | 3.6 | 3.0 | 3.3 |
| | difference in hardness H2 − H1 | 49 | 47 | 49 | 53 | 23 | 61 | 30 |
| Cover | composition | k | k | k | k | k | k | k |
| | hardness H3 (Shore D) | 59 | 59 | 59 | 59 | 59 | 59 | 59 |
| | thickness (mm) | 1.4 | 1.4 | 1.4 | 1.4 | 1.4 | 1.4 | 1.4 |
| Ball | difference in hardness H3 − H1 | 49 | 49 | 49 | 49 | 30 | 49 | 30 |
| | amount of compressive deformation (98N→1274N) (mm) | 3.1 | 3.1 | 3.5 | 3.1 | 3.2 | 2.6 | 2.9 |
| Durability | | 100 | 104 | 95 | 84 | 102 | 65 | 106 |
| Flight distance (m) | | 234 | 228 | 232 | 235 | 224 | 235 | 226 |
| Feel at impact | | A | C | A | A | D | B | D |

TABLE 5

| | | Evaluation Results | | | | | |
|---|---|---|---|---|---|---|---|
| | | Example 3 | Example 4 | Example 5 | Compara. Example 6 | Example 6 | Example 7 |
| Center | composition | b | a | a | a | a | a |
| | hardness H1 (Shore D) | 18 | 10 | 10 | 10 | 10 | 10 |
| | diameter (mm) | 22.0 | 22.0 | 22.0 | 20.0 | 22.0 | 22.0 |
| | specific gravity (g/cm$^3$) | 0.89 | 0.89 | 0.89 | 0.89 | 0.89 | 0.89 |
| | amount of compressive deformation (1kgf→10kgf) (mm) | 5.0 | 5.5 | 5.5 | 5.5 | 5.5 | 5.5 |
| Mid layer | composition | d | d | g | j | i | f |
| | thickness (mm) | 9.0 | 9.0 | 9.0 | 10.0 | 9.0 | 8.4 |
| | specific gravity (g/cm$^3$) | 1.19 | 1.19 | 1.19 | 1.17 | 1.19 | 1.22 |
| Core | surface hardness H2 (Shore D) | 59 | 59 | 61 | 71 | 52 | 56 |
| | diameter (mm) | 40.0 | 40.0 | 40.0 | 40.0 | 40.0 | 38.8 |
| | amount of compressive deformation (98N→1274N) (mm) | 3.4 | 3.5 | 3.5 | 2.8 | 4.3 | 3.5 |
| | difference in hardness H2 − H1 | 41 | 49 | 51 | 61 | 42 | 46 |
| Cover | composition | k | m | l | k | k | k |
| | hardness H3 (Shore D) | 59 | 65 | 54 | 59 | 59 | 59 |
| | thickness (mm) | 1.4 | 1.4 | 1.4 | 1.4 | 1.4 | 2.0 |
| Ball | difference in hardness H3 − H1 | 41 | 55 | 44 | 49 | 49 | 49 |
| | amount of compressive deformation (98N→1274N) (mm) | 3.0 | 2.9 | 3.2 | 2.4 | 3.9 | 3.1 |
| Durability | | 103 | 95 | 106 | 66 | 86 | 103 |
| Flight distance (m) | | 230 | 236 | 229 | 233 | 229 | 229 |
| Feel at impact | | B | A | A | B | A | A |

As shown in Tables 4 and 5, the golf ball of each Example is excellent in the durability, flight performance and feel at impact. Therefore, advantages of the present invention are clearly suggested by these results of evaluation.

The description herein above is merely for illustrative examples, and various modifications can be made without departing from the principles of the present invention.

What is claimed is:

1. A golf ball, comprising:

a core, and a cover positioned outside the core, wherein said core has a center and a mid layer positioned outside the center, and wherein:

the base polymer of the center includes a thermoplastic elastomer as a principal component, the center has a diameter of 19 mm or greater and 35 mm or less, the center has a Shore D hardness H1 of equal to or less than 25, the center has an amount of compressive deformation of 5.0 mm or greater and 10.0 mm or less, as measured with an initial load of 1 kgf and a final load of 10 kgf, the difference (H2−H1) between the surface hardness H2 of the core and the hardness H1 of the center is 25 or greater and 60 or less, and wherein the difference (H3−H1) between the hardness H3 of the cover and the hardness H1 of the center is 40 or greater and 65 or less.

2. The golf ball according to claim 1, wherein the base polymer of the center includes a styrene block-containing thermoplastic resin elastomer, a thermoplastic polyurethane elastomer, a thermoplastic polyester elastomer or a thermoplastic polyamide elastomer as a principal component.

3. The golf ball according to claim 1, wherein the mid layer is formed by crosslinking a rubber composition.

4. The golf ball according to claim 1, wherein the diameter of the center is 22.0 mm or greater and 35 mm or less.

5. A golf ball, comprising:

a core, and a cover positioned outside the core, wherein said core has a center and a mid layer positioned outside the center, and wherein:

the base polymer of the center includes a thermoplastic elastomer as a principal component, the center has a diameter of 19 mm or greater and 35 mm or less, the center has a Shore D hardness H1 of equal to or less than 25, the center has an amount of compressive deformation of 5.0 mm or greater and 10.0 mm or less, as measured with an initial load of 1 kgf and a final load of 10 kgf, the difference (H2−H1) between the surface hardness H2 of the core and the hardness H1 of the center is 25 or greater and 60 or less, and wherein the base polymer of the center includes a styrene block-containing thermoplastic resin elastomer, a thermoplastic polyurethane elastomer, a thermoplastic polyester elastomer or a thermoplastic polyamide elastomer as a principal component.

* * * * *